US008317275B2

(12) United States Patent
Han et al.

(10) Patent No.: US 8,317,275 B2
(45) Date of Patent: Nov. 27, 2012

(54) LAUNDRY DEVICE

(75) Inventors: Il Tak Han, Gimhae-si (KR); Sung Gi Hwang, Changwon-si (KR); Ju Han Yoon, Changwon-si (KR); Seong Kyu Kim, Gyeongsangnam-do (KR); Seon Il Heo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 817 days.

(21) Appl. No.: 12/097,783

(22) PCT Filed: Dec. 22, 2006

(86) PCT No.: PCT/KR2006/005668

§ 371 (c)(1),
(2), (4) Date: Nov. 26, 2008

(87) PCT Pub. No.: WO2007/073120

PCT Pub. Date: Jun. 28, 2007

(65) Prior Publication Data

US 2009/0153004 A1 Jun. 18, 2009

(30) Foreign Application Priority Data

Dec. 23, 2005 (KR) ..... 10-2005-0128789
Dec. 23, 2005 (KR) ..... 10-2005-0128790
Dec. 23, 2005 (KR) ..... 10-2005-0128791
Sep. 11, 2006 (KR) ..... 10-2006-0087287

(51) Int. Cl.
*D06F 37/00* (2006.01)

(52) U.S. Cl. ..... 312/228; 312/265.5

(58) Field of Classification Search ..... 312/228, 312/257.1, 265.5, 265.6, 263, 279; 68/3 R
See application file for complete search history.

(56) References Cited

U.S. PATENT DOCUMENTS 1,987,540 A 1/1935 Rekonty
(Continued)

FOREIGN PATENT DOCUMENTS

CN 2372343 Y 4/2000
(Continued)

OTHER PUBLICATIONS

Korean language publication of (KR) 20-2005-0010568, publication date Sep. 8, 2005.*

(Continued)

*Primary Examiner* — Darnell Jayne
*Assistant Examiner* — Timothy M Ayres
(74) *Attorney, Agent, or Firm* — KED & Associates, LLP

(57) ABSTRACT

A washing machine is disclosed, by which assembly and disassembly of a control panel (70) is facilitated to an installing arrangement of the washing machine and by which a control panel (70) is configured stable against heat or water coming from the inside of the washing machine. The present invention includes a body case configuring an exterior of the washing machine, a top plate (80) provided to a topside of the body case, a control panel (70) attached to a front side of the body case to perform various manipulations required for an operation of the washing machine, and a panel frame (100) provided to an upper or lower part of the front side of the body case to be externally exposed in part, the panel frame (100) having one side connected to the top plate (80) and the other side assembled to the control panel (70).

9 Claims, 7 Drawing Sheets

U.S. PATENT DOCUMENTS

| | | | | |
|---|---|---|---|---|
| 3,588,213 | A * | 6/1971 | Braga et al. | 312/228 |
| 3,983,387 | A | 9/1976 | Van Steenhoven et al. | 240/147 |
| 4,288,133 | A * | 9/1981 | Deatherage | 312/279 |
| 4,428,444 | A | 1/1984 | Whittaker et al. | |
| 4,798,424 | A * | 1/1989 | Coates et al. | 312/257.1 |
| 4,974,262 | A | 12/1990 | Rosen | 4/236 |
| 5,357,565 | A | 10/1994 | Butler, III et al. | 379/412 |
| 5,738,424 | A * | 4/1998 | Katz et al. | 312/293.3 |
| 5,901,417 | A | 5/1999 | Alexiou | 24/90.5 |
| 6,065,820 | A * | 5/2000 | Fleissner et al. | 312/265.5 |
| 6,070,295 | A | 6/2000 | Huslebus | 16/254 |
| 6,109,710 | A * | 8/2000 | Wu et al. | 312/223.2 |
| 6,502,431 | B1 * | 1/2003 | Yamano et al. | 68/3 R |
| 7,395,683 | B2 * | 7/2008 | Kim et al. | 68/12.27 |
| 7,490,492 | B2 * | 2/2009 | Kim et al. | 68/12.27 |
| 7,748,243 | B2 * | 7/2010 | Park et al. | 68/196 |
| 2004/0107738 | A1 * | 6/2004 | Kim et al. | 68/3 R |
| 2005/0122011 | A1 | 6/2005 | Hwang et al. | 312/223.2 |
| 2005/0178164 | A1 * | 8/2005 | Kim et al. | 68/3 R |
| 2005/0179347 | A1 * | 8/2005 | Kim et al. | 312/228 |
| 2005/0183469 | A1 | 8/2005 | Kang | 68/3 |
| 2005/0268667 | A1 * | 12/2005 | Yoon et al. | 68/3 R |
| 2006/0255700 | A1 * | 11/2006 | Park et al. | 312/228 |
| 2007/0052332 | A1 * | 3/2007 | Kim | 312/228 |
| 2007/0209403 | A1 * | 9/2007 | Byun et al. | 68/3 R |
| 2008/0053159 | A1 * | 3/2008 | Hwang et al. | 68/12.01 |
| 2009/0066205 | A1 * | 3/2009 | Park et al. | 312/228 |
| 2009/0126419 | A1 * | 5/2009 | Yoon et al. | 68/212 |
| 2009/0217545 | A1 * | 9/2009 | Banicevic et al. | 34/89 |

FOREIGN PATENT DOCUMENTS

| | | | |
|---|---|---|---|
| CN | 2549032 | Y | 5/2003 |
| CN | 1535805 | A | 10/2004 |
| DE | 42 40 888 | A1 | 6/1994 |
| EP | 0 875 196 | B1 | 11/1998 |
| EP | 0 893 532 | A1 | 1/1999 |
| GB | 2 243 770 | A | 11/1991 |
| JP | 7-323191 | | 12/1995 |
| JP | 11-057292 | A | 3/1999 |
| JP | 11-333193 | | 12/1999 |
| JP | 2000-271392 | A | 10/2000 |
| KR | 20-1998-0031814 | | 8/1998 |
| KR | 10-2005-042320 | | 5/2005 |
| KR | 10-2005-0054201 | | 6/2005 |
| WO | WO 02/090640 | A1 | 11/2002 |
| WO | WO 2006/126812 | A2 | 11/2006 |

OTHER PUBLICATIONS

International Search Report dated May 21, 2007.
Chinese Office Action dated Aug. 7, 2009 for Application No. 200710192923.1.
Office Action dated Oct. 8, 2010 issued in U.S. Appl. No. 11/848,705.
European Search Report dated Nov. 28, 2008.
PCT International Search Report dated Apr. 17, 2007.
Office Action dated Aug. 30, 2011 issued in U.S. Appl. No. 12/097,777.
U.S. Final Office Action dated Jun. 14, 2010 issued in U.S. Appl. No. 11/848,705.
Office Action issued in U.S. Appl. No. 12/097,777 dated Mar. 19, 2012.

* cited by examiner

LAUNDRY DEVICE

TECHNICAL FIELD

The present invention relates to a washing machine, and more particularly, to a washing machine and a control panel assembly thereof. Although the present invention is suitable for a wide scope of applications, it is particularly suitable for facilitating assembly and disassembly of the washing machine and deciding a position of a control panel selectively.

BACKGROUND ART

Generally, washing machines are classified into a pulsator type tub-rotating washing machine, a drum type washing machine, a laundry dryer for drying washed laundry, and the like.

In the various washing machines, a control panel having input buttons, rotary knob, display device and the like for controlling the washing machine are provided to a front case of the washing machine.

A general type washing machine among the above-explained washing machines is explained with reference to the attached drawings as follows for example.

For this, a configuration of a general type washing machine according to a related art is explained as follows.

FIG. 1 is a perspective diagram of a washing machine according to a related art.

Referring to FIG. 1, a control panel assembly 2 having input buttons 6, a rotary knob 3, a display window 4 for displaying a remaining time and the like is installed at an upper part of a body case 1 configuring an exterior of a washing machine according to a related art. And, a drum (not shown in the drawing) is provided within the body case 1 to communicate with a door provided to a front side of the washing machine.

FIG. 2 is a diagram of a pair of washing machines according to a related, in which a pair of the washing machines are stacked on each other.

Referring to FIG. 2, a pair of washing machines according to a related art are stacked on each other to utilize a space efficiently.

DISCLOSURE OF INVENTION

Technical Problem

However, in using the washing machines stacked on each other, the upper washing machine has the control panel provided at a too high level. So, a user has difficulty in reaching the control panel with hands. To overcome such a difficulty, a user needs a ladder or chair to step on to manipulate the upper washing machine, which causes inconvenience to the user in using the upper washing machine.

Accordingly, the present invention is directed to a washing machine that substantially obviates one or more of the problems due to limitations and disadvantages of the related art.

An object of the present invention is to provide a washing machine, by which assembly and disassembly of a control panel is facilitated according to an installing arrangement of the washing machine.

Another object of the present invention is to provide a washing machine, by which a control panel is configured stable against heat or water coming from the inside of the washing machine.

Technical Solution

To achieve these and other advantages and in accordance with the purpose of the present invention, as embodied and broadly described, a washing machine according to the present invention includes a body case configuring an exterior of the washing machine, a top plate provided to a topside of the body case, a control panel attached to a front side of the body case to perform various manipulations required for an operation of the washing machine, and a panel frame provided to an upper or lower part of the front side of the body case to be externally exposed in part, the panel frame having one side connected to the top plate and the other side assembled to the control panel.

Preferably, the panel frame includes a deco part parallel with the top plate to be externally exposed, a locking end bent vertically and downwardly from a front side of the deco part to be locked to the control panel, a vertical end bent vertically and downwardly from a rear side of the deco part, and a support end bent from a portion of the vertical end in a rear direction to support the top plate.

More preferably, a hanging hole is provided to the locking end, a hanging projection is provided to the control panel, and the control panel is connected to the panel frame if the hanging projection is held by the hanging hole. In this case, a hook is provided to one end portion of the hanging projection.

More preferably, a plurality of the hanging holes are provided along a length direction of the panel frame and a plurality of the hanging projections are provided to the control panel to correspond to a plurality of the hanging holes, respectively.

More preferably, a hanging projection is provided to the locking end, a hanging hole is provided to the control panel, and the hanging projection is held by the hanging hole. In this case, a hook is provided to one end portion of the hanging projection.

More preferably, a plurality of the hanging holes are provided along a length direction of the control panel and a plurality of the hanging projections are provided to the panel frame panel to correspond to a plurality of the hanging holes, respectively.

Preferably, a cover panel is further provided to a portion of the front side of the panel frame or the lower part of the front side of the body case except a place where the control panel is provided to cover the corresponding portion.

More preferably, a detachable configuration between the panel frame and the cover panel is equal to that between the panel frame and the control panel.

To further achieve these and other advantages and in accordance with the purpose of the present invention, a washing machine includes a body case configuring an exterior of the washing machine, a top plate provided to a topside of the body case, a panel frame provided to an upper or lower part of a front side of the body case, a control panel assembled to the panel frame to perform various manipulations required for an operation of the washing machine, and a deco part having one side assembled to the panel frame and the other side assembled to the control panel.

Preferably, the panel frame includes a support end supporting a bottom of the front side of the top plate and an adhering end upwardly bent from a tip of the support end to adhere closely to the front side of the plate.

More preferably, the deco part includes a fixing end adhering closely to a front side of the adhering end, an exposing end bent from an upper end portion of the fixing end in a front direction to be externally exposed, and a locking end bent downwardly from a front end portion of the exposing end to assemble the control panel thereto.

In this case, the washing machine further includes a fixing member making the deco part adhere closely to the adhering end of the panel frame. And, the fixing member is configured to be assembled to the front side of the top plate by penetrating into both of the fixing end of the deco part and the adhering end of the panel frame.

Preferably, the washing machine further includes a locking part locking the deco part and the control panel together.

More preferably, the locking part includes a hanging hole provided to the locking end of the deco part and a hanging projection provided to a rear side of the control panel to have a configuration downwardly bent to be held by the hanging hole. In this case, a plurality of hanging protrusions are provided along a long side of the control panel and a plurality of hanging holes are provided to the locking end of the deco part to correspond to a plurality of the hanging projections, respectively.

Preferably, the washing machine further includes a cover panel covering a corresponding part of the front side of the deco part or the lower part of the front side of the body case except a place where the control panel is assembled.

More preferably, a detachable configuration between the panel frame and the cover panel is equal to that between the panel frame and the control panel.

To further achieve these and other advantages and in accordance with the purpose of the present invention, a washing machine includes a body case configuring an exterior of the washing machine, a control panel attached to a front side of the body case to enable various manipulations for an operation of the washing machine, a top plate provided to a topside of the body case, a panel frame provided to an upper or lower part of the front side of the body case to support a front side of the top plate, and a deco part provided between the control panel and the top plate to be externally exposed on the panel frame.

Preferably, the panel frame includes a vertical frame part, a support end vertically bent in a rear direction from a prescribed portion of the vertical frame part to support a front side of the top plate, and a horizontal end bent in a front direction from an upper end portion of the vertical frame part. In this case, the deco part is provided to an upper surface of the horizontal end of the panel frame.

And, the washing machine further includes a locking device provided to the horizontal end of the panel frame and the deco part to lock the horizontal end and the deco part together. Moreover, the locking device includes a hanging projection provided to either an upper surface of the horizontal end of the panel frame or a bottom side of the deco part opposing the upper surface of the horizontal end and a hanging hole provided to either the upper surface of the horizontal end of the panel frame or the bottom side of the deco part opposing the upper surface of the horizontal end to hold the hanging projection therein.

More preferably, the hanging projection is configured in a manner of being downwardly projected from the upper surface of the horizontal end of the panel frame or the bottom side of the deco part and then being bent in a front or rear direction. Besides, a plurality of hanging projections are provided along a long and/or short side direction of the deco part and a plurality of hanging holes are provided to portions of the horizontal end of the panel frame to correspond to a plurality of the hanging projections, respectively.

Preferably, the control panel is selectively and detachably attached to at least one of the horizontal end of the panel frame and the lower part of the front side of the body case.

Preferably, the washing machine further includes a cover panel covering either the horizontal end of the panel frame or the lower part of the front side of the body case except a portion where the control panel is provided.

To further achieve these and other advantages and in accordance with the purpose of the present invention, a washing machine includes a body case configuring an exterior of the washing machine, a panel frame provided to an upper or lower part of a front side of the body case, a control panel provided in front of the panel frame to perform various manipulations required for an operation of the washing machine, a deco part configuring an upper front side portion of the body case to be locked to the body case by sliding from one side of the body case to the other side of the body case, and a locking means for locking the deco part to the body case by having the deco part slide from the one side of the body case to the other side of the body case.

Preferably, the locking means includes an upper flange part provided to the panel frame, a sliding locking recess provided to the upper flange part to have a slit shape in a lateral direction, and a sliding locking projection provided to a bottom side of the deco part to correspond to the sliding locking recess.

More preferably, the sliding locking projection includes an insertion piece inserted in the sliding locking recess and a hanging piece bent in a lateral direction of the insertion piece not to be separated upwardly by being interrupted by the upper flange part in case of moving the deco part from one side to the other side on the upper flange part after having been fitted into the sliding locking recess. And, a projecting portion having a wedge shape upwardly inclined from the other side in a direction of one side is provided to a lower part of the deco part to facilitate a separation of the deco part in a manner of configuring a prescribed gap from the upper flange part if the deco part slides to move from the other side to one side on the control panel and wherein an insertion portion is provided to the upper flange part of the control panel to correspond to the projecting portion.

Preferably, in case that the deco part is moved from the other side to one side to be separated, an incline upwardly inclining is provided to one side portion of the deco part to facilitate a separation.

Besides, a portion of the control panel opposing the one lateral side of the deco part provided with the incline is configured to have an incline corresponding to that of the deco part.

Preferably, opposing sides of the control panel and the deco part on the other side are configured vertical to enable the deco part to move for a separation if the control panel is moved the other side to one side.

To further achieve these and other advantages and in accordance with the purpose of the present invention, a washing machine includes a body case configuring an exterior of the washing machine, a panel frame provided to an upper or lower part of a front side of the body case, a control panel detachably provided to a front side of the panel frame selectively, a deco part configuring an upper front side portion of the body case to be locked to the body case by sliding from one side of the body case to the other side of the body case, a sliding guide means for enabling the control panel to slide to move to a locking position by being guided by the panel frame, the sliding guide means provided to an end portion of one side the panel frame and an inside of one side of the control panel, and a locking member locking an end portion of the other side of the panel frame and the other side of the control panel together.

Preferably, the locking member is assembled to the control panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

First of all, a washing machine according to a first or second embodiment of the present invention is explained with reference to FIGS. 3 to 6.

Figure 1:
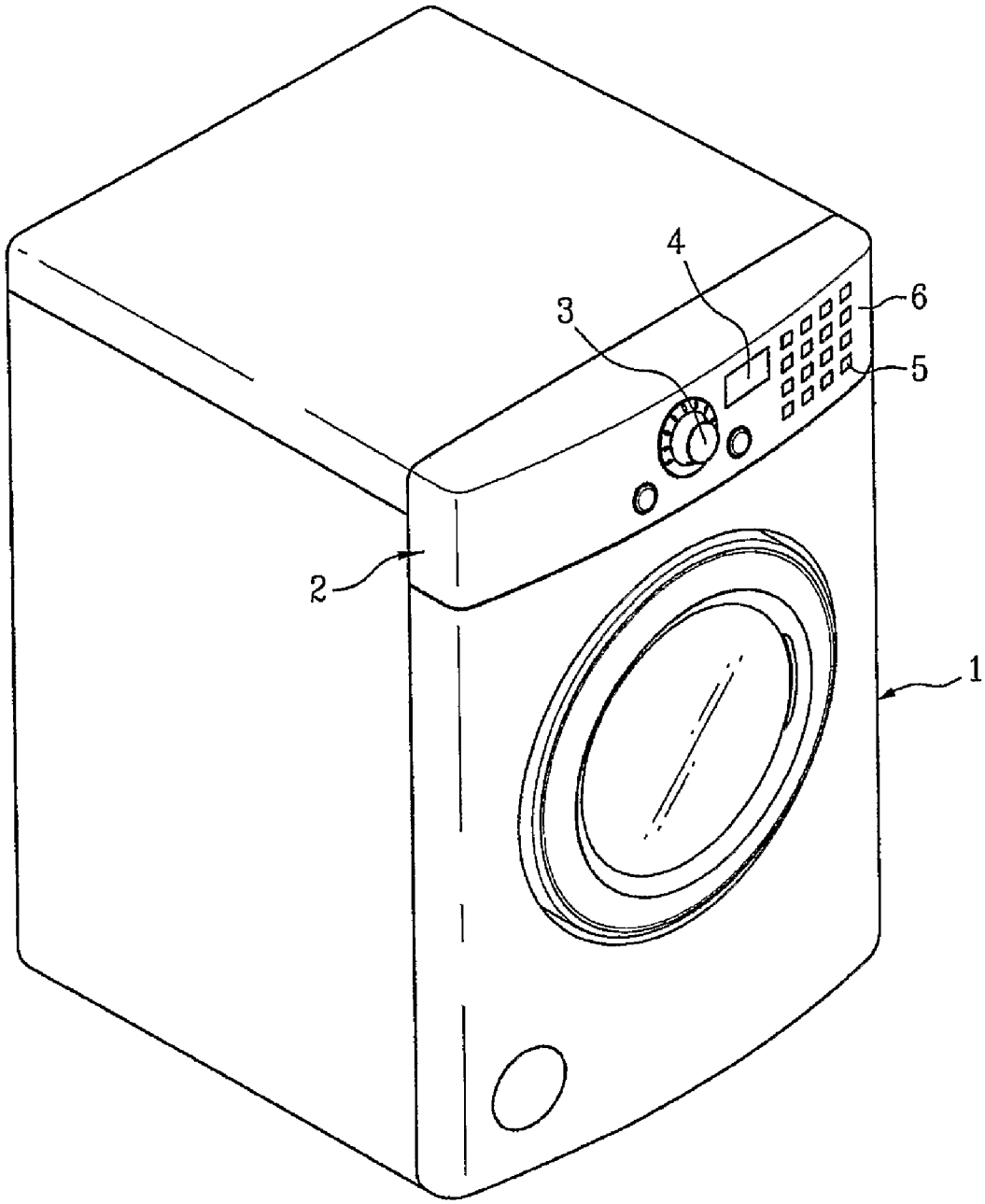
FIG. 1 is a perspective diagram of a washing machine according to a related art.
Figure 2:
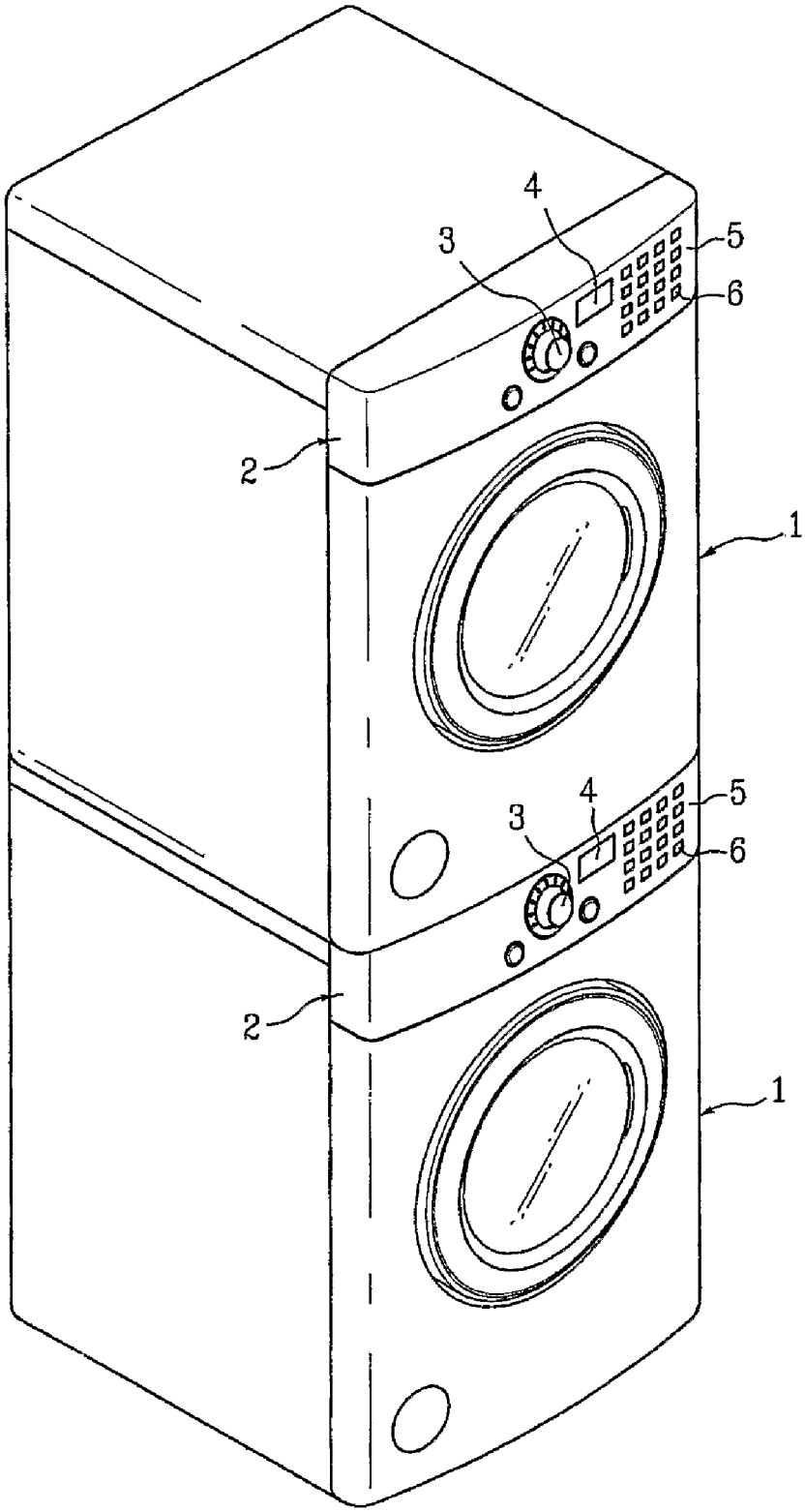
FIG. 2 is a diagram of a pair of washing machines according to a related, in which a pair of the washing machines are stacked on each other.
Figure 3:
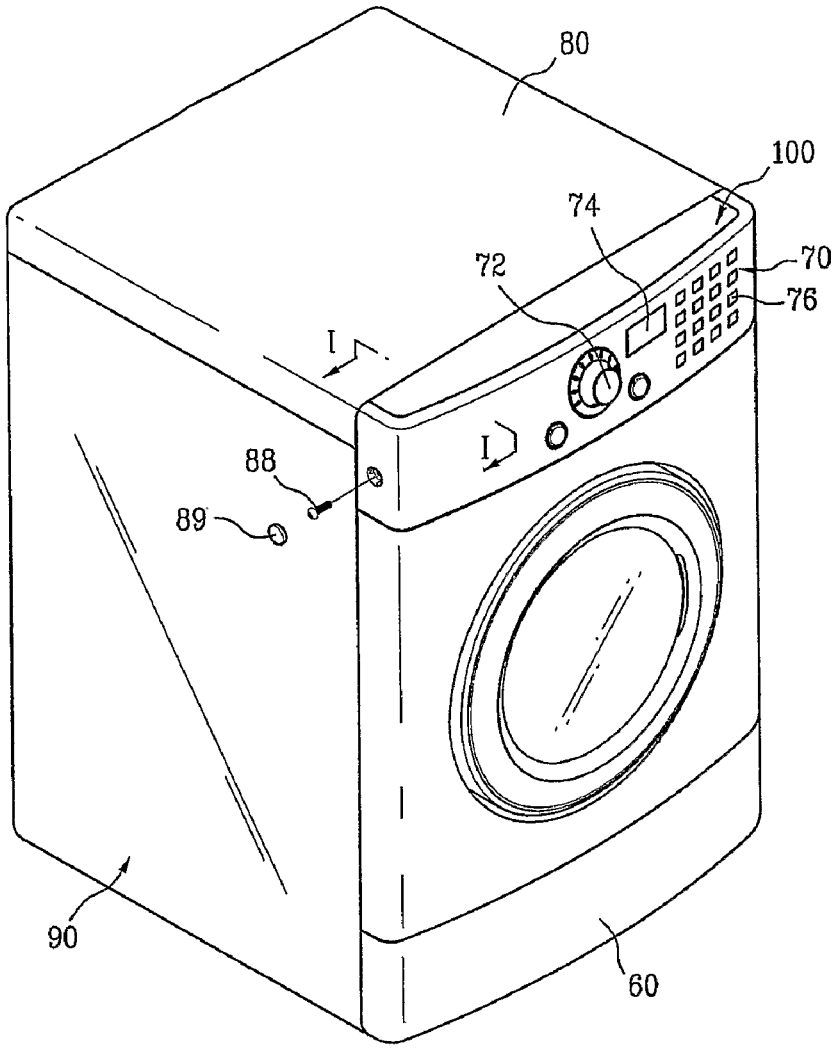
FIG. 3 is a schematic perspective diagram of a washing machine according to a first or second embodiment of the present invention.

FIG. 3 is a schematic perspective diagram of a washing machine according to a first or second embodiment of the present invention.

Referring to FIG. 3, a washing machine according to a first or second embodiment of the present invention includes a body case 90 configuring an exterior of the washing machine, a top plate 80 provided to a topside of the body case 90, a control panel 70 provided to an upper or lower part of a front side of the body case 90 to perform various manipulations required for an operation of the washing machine, and a panel frame 100 provided to the upper or lower part of the front side of the body case 90 to be externally exposed in part, the panel frame 100 having one side connected to the top plate 80 and the other side assembled to the control panel 70.

Figure 4:
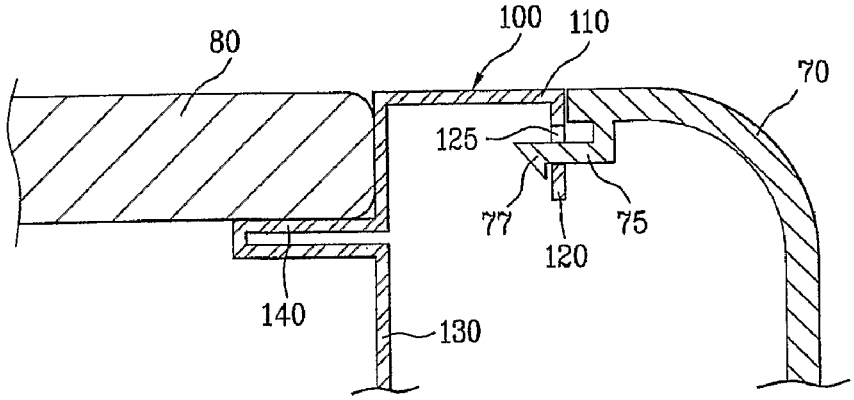
FIG. 4 is a cross-sectional diagram according to a cutting line I-I in FIG. 3.

Referring to FIG. 4, the panel frame 100 includes a deco part 110 exposed externally, a locking end 120 bent vertically and downwardly from a front side of the deco part 110 to be locked to the control panel 70, a vertical end 130 bent vertically and downwardly from a rear side of the deco part 110, and a support end 140 bent from a portion of the vertical end 130 in a rear direction to support the top plate 80.

The washing machine according to the first embodiment of the present invention is provided with a locking means for locking the control panel 70 and the locking end 120 together. The locking means includes a hanging hole 125 provided to the locking end 120 of the panel frame 100 and a hanging projection 75 provided to the control panel 70 to be held by the hanging hole 125. The locking end 120 and the hanging projection 75 are provided to one end of the other side of the panel frame 100 and one end of the control panel 70 opposing the one end of the other side of the panel frame 100, respectively.

In this case, a hook 77, as shown in the drawing, is preferably provided to a tip of the hanging projection 75 to enable the hanging projection 75 fitted into the hanging hole 125 to be held tight by the hanging hole 125.

Preferably, a plurality of hanging holes 125 are provided in a length direction of the control panel 70 overall and a plurality of hanging projections 75 are provided to the control panel 70 to correspond to a plurality of the hanging holes 125, respectively.

Meanwhile, the control panel 70 is detachably and selectively assembled to at least one of the front side of the panel frame 100 and a lower part of the front side of the body case 90.

And, a cover panel 60 is further provided to a part corresponding to an upper or lower part of the front side of the panel frame 100 or the lower part of the front side of the body case 90 except the part where the control panel 70 is assembled.

In this case, a printed circuit board (not shown in the drawing) is attached to the panel frame 100 where the control panel is assembled to configure a structure electrically connected to the buttons 76, the display window 74, the rotary knob 72, and the like.

In particular, the printed circuit board is a circuit board electrically connected to the buttons 76, rotary knob 72, display window 74 and the like of the control panel 70. The printed circuit board is provided to each of the upper and lower parts of the body case 90 to have the same configuration. Preferably, sizes of the control panel 70 and the cover panel 60 are decided to be compatible with each other.

By constructing the above-explained configurations, the cover panel 60 can be installed at the place from which the control panel 70 is detached, and vice versa.

In this case, an installation structure of the cover panel 60 is preferably configured equal to that of the control panel 70.

The control panel 70, as shown in FIG. 3, is assembled to the body case 90 using a locking screw 88 locked to at least one side of the body case 90.

Preferably, the locking screw 88 is covered with a hiding cap 89, as shown in FIG. 3, not to be externally seen.

Figure 5:
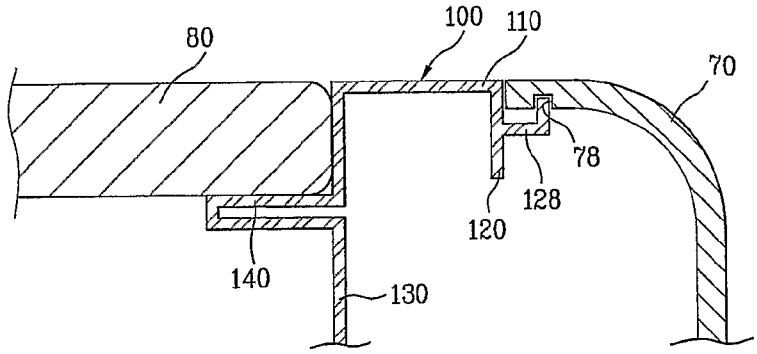
FIG. 5 is a cross-sectional diagram of the washing machine according to the first embodiment of the present invention shown in FIG. 3 along a cutting line I-I.

FIG. 5 is a cross-sectional diagram of the washing machine according to the first embodiment of the present invention shown in FIG. 3 along a cutting line I-I.

Referring to FIG. 5, a locking end 120 having a downwardly bent shape and a locking piece 128 bent from the locking end 120 in a front direction are provided to a front side of an externally exposed deco part 110 of a panel frame 100. And, a locking recess 78 to be locked by the locking piece 128 is provided to a control panel 70 to correspond to the configurations of the locking end 120 and the locking piece 128.

In the first embodiment of the present invention, a panel frame (hereinafter named 'lower panel frame': not shown in the drawing) is further provided to a lower part of an open front side of a body case 90, and more particularly, to a lower part of a cover cabinet.

In this case, the lower panel frame is configured to achieve a stable assembly of the control panel 70 assembled to the lower part of the front side of the body case 90 and to keep heat or water discharged from an inside of the body case 90 from entering the control panel 70.

An operation of the above-explained first embodiment of the present invention is explained as follows.

First of all, after the cover panel 60 covering the printed circuit board (not shown in the drawings) provided to the lower part of the body case 90 has been separated from the body case 90, the screw 88 of the control panel 70 provided to the upper part of the body case 90 is unscrewed. The locking projection 75 is unlocked from the hanging hole 125 to separate the control panel 70 from the panel frame 100. The separated control panel 70 is assembled to the lower part of the body case where the cover panel was installed. And, the separated cover panel 60 is assembled to the part where the control panel 70 was installed.

Thus, the washing machine having the control panel 70 assembled to the lower part of the body case 90 is placed on the other washing machine having its control panel 70 assembled to its upper part.

Meanwhile, since the printed circuit board (not shown in the drawings) is provided within the body case 90 where the control panel 70 and the cover panel 60 are installed to have the configuration electrically connected to the input buttons 76, the display window 74 and the like of the control panel 70 provided to the upper/lower part of the body case 90, it does not matter that the control panel 70 is provided to the upper or lower part of the body case 90 to operate the corresponding washing machine.

Figure 6:
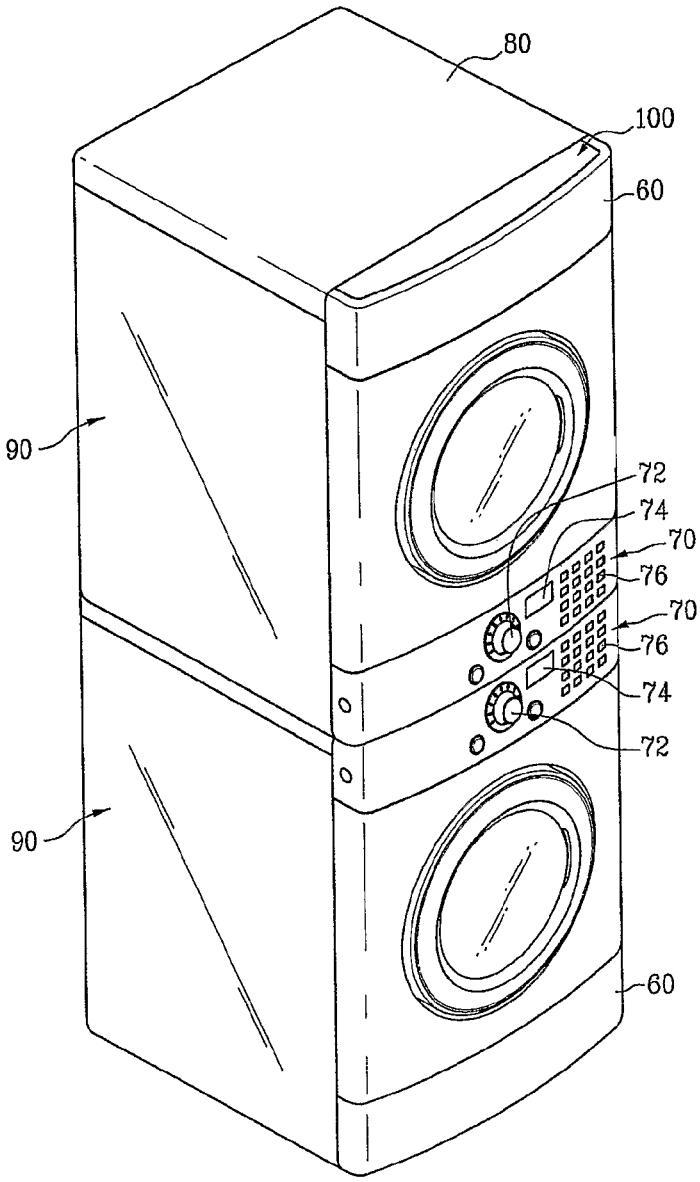
FIG. 6 is a diagram of a pair of washing machines according to the present invention, in which a pair of the washing machines are stacked on each other.

In particular, in case that a par of washing machines, as shown in FIG. 6, are stacked on each other, a user is facilitated to manipulate the upper washing machine without using a chair or ladder in a manner of providing the control panel 70 to the lower part of the upper washing machine. And, the control panel and the panel frame are easily disassembled from each other.

A washing machine according to a second embodiment of the present invention is explained as follows.

Figure 7:
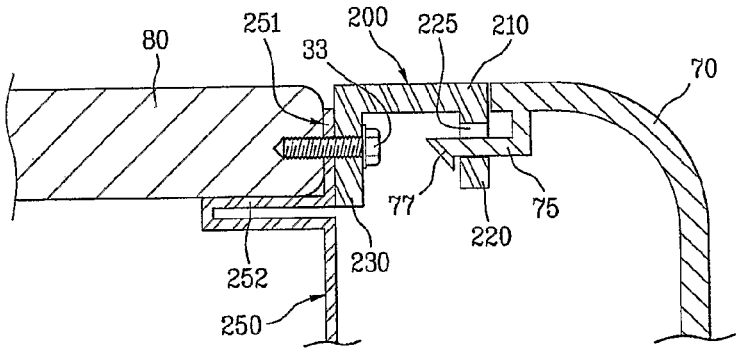
FIG. 7 is a cross-sectional diagram of the washing machine according to the second embodiment of the present invention shown in FIG. 3 along a cutting line I-I.

FIG. 7 is a cross-sectional diagram of the washing machine according to the second embodiment of the present invention shown in FIG. 3 along a cutting line I-I.

Referring to FIG. 3 and FIG. 7, a washing machine according to a second embodiment of the present invention includes a body case 90 configuring an exterior of the washing machine, a top plate 80 provided to a topside of the body case 90, a panel frame 250 supporting a front side of the top plate 80, a control panel 70 provided to an upper or lower part of a front side of the body case 90 to perform various manipulations required for an operation of the washing machine, and a deco part 200 having one side assembled to the panel frame 250 and the other side assembled to the control panel 70.

The panel frame 250 includes a support end 252 supporting the front side of the top plate 80 and an adhering end 251 upwardly bent from a tip of the support end 252 to adhere closely to the front side of the plate 80.

And, the deco part 200 includes a fixing end 230 adhering closely to a front side of the adhering end 252, an exposing end 210 bent from an upper end of the fixing end 230 in a front direction to be externally exposed, and an locking end 220 bent downwardly from a front end of the exposing end 210 to assemble the control panel 70 thereto.

The washing machine according to the second embodiment of the present invention further includes a fixing member making the deco part 200 adhere closely to the adhering end 251 of the panel frame 250.

The fixing member is configured to be assembled to the front side of the top plate 80 by penetrating into both of the fixing end 230 of the deco part 200 and the adhering end 251 of the panel frame 200.

The fixing member, as shown in FIG. 7, includes a locking screw 33 in general.

The washing machine according to the second embodiment of the present invention further includes a locking part that locks the deco part 200 and the control panel 70 together.

In this case, the locking part includes a hanging hole 225 provided to the locking end 220 provided to the front side of the deco part 200 and a hanging projection 75 provided to a rear side of the control panel to have a configuration downwardly bent to be held by the hanging hole 225.

Preferably, a plurality of hanging protrusions 75 are provided along a long side of the control panel 70 and a plurality of hanging holes 225 are provided to the locking end 120 of the deco part 200 to correspond to a plurality of the hanging projections 75, respectively.

And, the body case 90 is configured in a manner that the control panel 70 is detachably and selectively assembled to at least one of the front side of the deco part 200 and the lower part of the front side of the body case 90.

Preferably, a hook 77, as shown in FIG. 7, is provided to a tip of the hanging projection 75.

Meanwhile, the washing machine according to the second embodiment of the present invention, as shown in FIG. 3, is further provided with a cover panel 60 covering a corresponding part of the front side of the deco part 110 or the lower part of the front side of the body case 90 except the place where the control panel 70 is assembled.

In this case, sizes and shapes of the control panel 70 and the cover panel 60 are decided to be compatible with each other.

And, the cover panel 60 of the second embodiment of the present invention has the same installation structure of the control panel 70 to be assembled/disassembled.

Meanwhile, in the second embodiment of the present invention, a panel frame (hereinafter named 'lower panel frame': not shown in the drawing) is further provided to a lower part of an open front side of the body case 90.

In this case, the lower panel frame is configured to achieve a stable assembly of the control panel 70 assembled to the lower part of the front side of the body case 90 and to keep heat or water discharged from an inside of the body case 90 from entering the control panel 70.

An operation of the above-explained second embodiment of the present invention is explained as follows.

First of all, the hanging projection 75 of the control panel 70 is separated from the hanging hole 225 of the deco part 200.

Like the washing machine according to the first embodiment of the present invention, in case of stacking the washing machine according to the second embodiment of the present invention on the other washing machine, it is able to assemble the control panel and the cover panel to the lower and upper parts of the corresponding washing machine, respectively. Hence, manipulations of both of the sacked washing machines are facilitated.

A washing machine according to a third embodiment of the present invention is explained with reference to FIG. 8 and FIG. 9 as follows.

Figure 8:
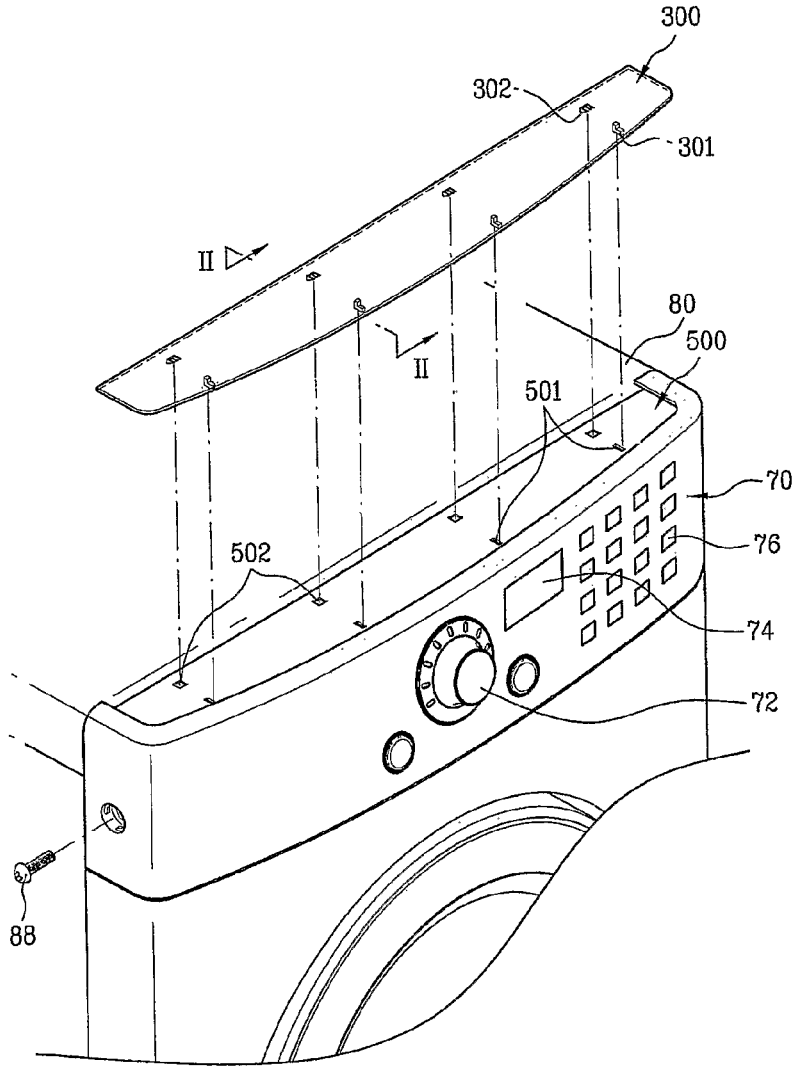
FIG. 8 is an exploded diagram of a control panel assembly of a washing machine according to a third embodiment of the present invention.
Figure 9:
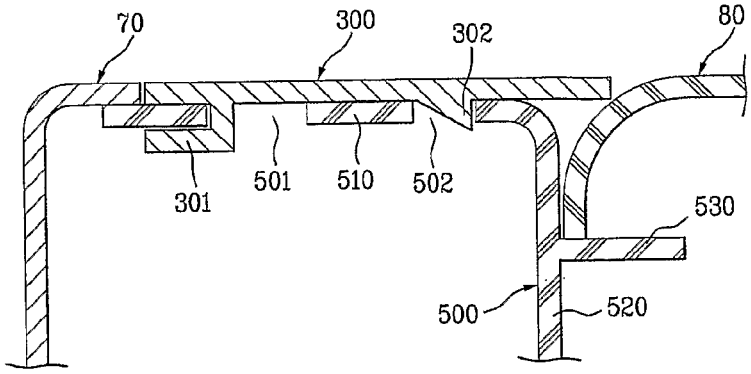
FIG. 9 is a cross-sectional diagram along a cutting line II-II in FIG. 8.

FIG. 8 is an exploded diagram of a control panel assembly of a washing machine according to a third embodiment of the present invention and FIG. 9 is a cross-sectional diagram along a cutting line II-II in FIG. 8.

Referring to FIG. 8 and FIG. 9, a washing machine according to a third embodiment of the present invention includes a body case configuring an exterior of the washing machine, a control panel 70 attached to an upper or lower part of a front side of the body case to enable various manipulations for an operation of the washing machine, a top plate 80 provided to a topside of the body case, a panel frame 500 provided in front of the top plate 80 to support a front side of the top plate 80, and a deco part 300 provided between the control panel 70 and the top plate 80 to be exposed on the panel frame 500.

The control panel 70, as shown in FIG. 8, of the washing machine according to the third embodiment of the present invention includes input buttons 76 for function inputs a rotary knob 72 for the function inputs, a display window 74 displaying a remaining time, and the like.

The panel frame 500, as shown in FIG. 9, includes a horizontal end 510 parallel with the topside of the top plate 80, a vertical end 520 vertically bent downward from a rear end of the horizontal end 510, and a support end 530 vertically bent downward from a prescribed portion of the vertical end 520 to support the top plate 80.

Meanwhile, a locking device is provided to the horizontal end 510 of the panel frame 500 and the deco part 300 to lock them together.

The locking device, as shown in FIG. 9, includes a hanging projection 301 provided to either an upper surface of the horizontal end 510 of the panel frame or a bottom side of the deco part 300 opposing the upper surface of the horizontal end 510 and a hanging hole 501 provided to either the upper surface of the horizontal end 510 of the panel frame or the bottom side of the deco part 300 opposing the upper surface of the horizontal end 510 to hold the hanging projection 301 therein.

In FIG. 9, the hanging hole 501 is provided to the upper surface of the horizontal end 510 of the panel frame 500 and the hanging projection 301 is provided to the deco part 300, for example.

In this case, the hanging projection 301 is configured in a manner of being downwardly projected from the upper surface of the horizontal end 510 of the panel frame 500 or the bottom side of the deco part 300 and then being bent in a front or rear direction.

A fixing recess 502 is provided to the upper surface of the horizontal end 510 of the panel frame 500 and a fixing projection 302 is provided to the bottom side of the deco part 300 to correspond to the fixing recess 502.

Preferably, a plurality of hanging projections 301 and a plurality of fixing projections 302 are provided along a long and/or short side direction of the deco part 300 and a plurality of hanging holes 501 and a plurality of fixing recesses 502 are provided to portions of the horizontal end 510 of the panel frame 500 to correspond to a plurality of the hanging projections 301 and a plurality of the fixing projections 302, respectively.

And, the body case is configured to enable to control panel 70 to be selectively and detachably attached to at least one of the horizontal end 510 of the panel frame 500 and the lower part of the front side of the body.

Like the washing machine according to the first or second embodiment of the present invention, a cover panel 60 is further provided to the upper or lower part of the front side of the body case except a portion where the control panel 70 is assembled to cover the corresponding part.

Since the cover panel has been sufficiently explained in the foregoing descriptions of the former embodiments of the present invention, it explanation is omitted in the following description.

Meanwhile, the control panel 70, as shown in FIG. 8, is configured to be fixed to the panel frame 500 by a locking screw 88 provided to at least one side of the control panel 70.

In the third embodiment of the present invention, a panel frame (hereinafter named 'lower panel frame': not shown in the drawing) is further provided to a lower part of an open front side of the body case 90.

An operation of the above-explained washing machine according to the third embodiment of the present invention is explained as follows.

First of all, the deco part 300 is fixed to the horizontal end 510 of the panel frame 500.

For this, the deco part 300 is moved in a front direction from a rear side of the washing device so that the hanging projection 301 of the deco part 300 can be locked to the hanging hole 501 provided to the horizontal end 510 of the panel frame 500.

In this case, as the fixing projection is fixed to the fixing recess 502, whereby the deco part 300 is able to keep being fixed to the panel frame 500.

In case that the washing machine of the present invention is stacked on another washing machine, the cover panel 60 covering the printed circuit board provided to the lower part of the body case 90 is separated from the body case 90. The control panel 70 having been provided to the upper part of the body case 90 is then assembled to the portion from which the cover panel 60 is removed. Finally, the separated cover panel 60 is provided to cover the portion where the control panel was installed.

In doing so, after the deco part 300 has been disassembled in a sequence reverse to the assembling sequence of the panel frame, the control panel 70 is separated from the panel frame 500.

Thus, the washing machine having the control panel 70 assembled to the lower part of the body case 90 is stacked on the other washing machine of which control panel 70 is assembled to its upper part.

Meanwhile, since the printed circuit board (not shown in the drawings) is provided within the body case 90 where the control panel 70 and the cover panel 60 are installed to have the configuration electrically connected to the input buttons 76, the display window 74 and the like of the control panel 70 provided to the upper/lower part of the body case 90, it does not matter that the control panel 70 is provided to the upper or lower part of the body case 90 to operate the corresponding washing machine.

In particular, in case that a pair of washing machines are stacked on each other, a user is facilitated to manipulate the upper washing machine without using a chair or ladder in a manner of providing the control panel 70 to the lower part of the upper washing machine.

A washing machine according to a fourth embodiment of the present invention is explained with reference to FIGS. 10 to 12 as follows.

Figure 10:
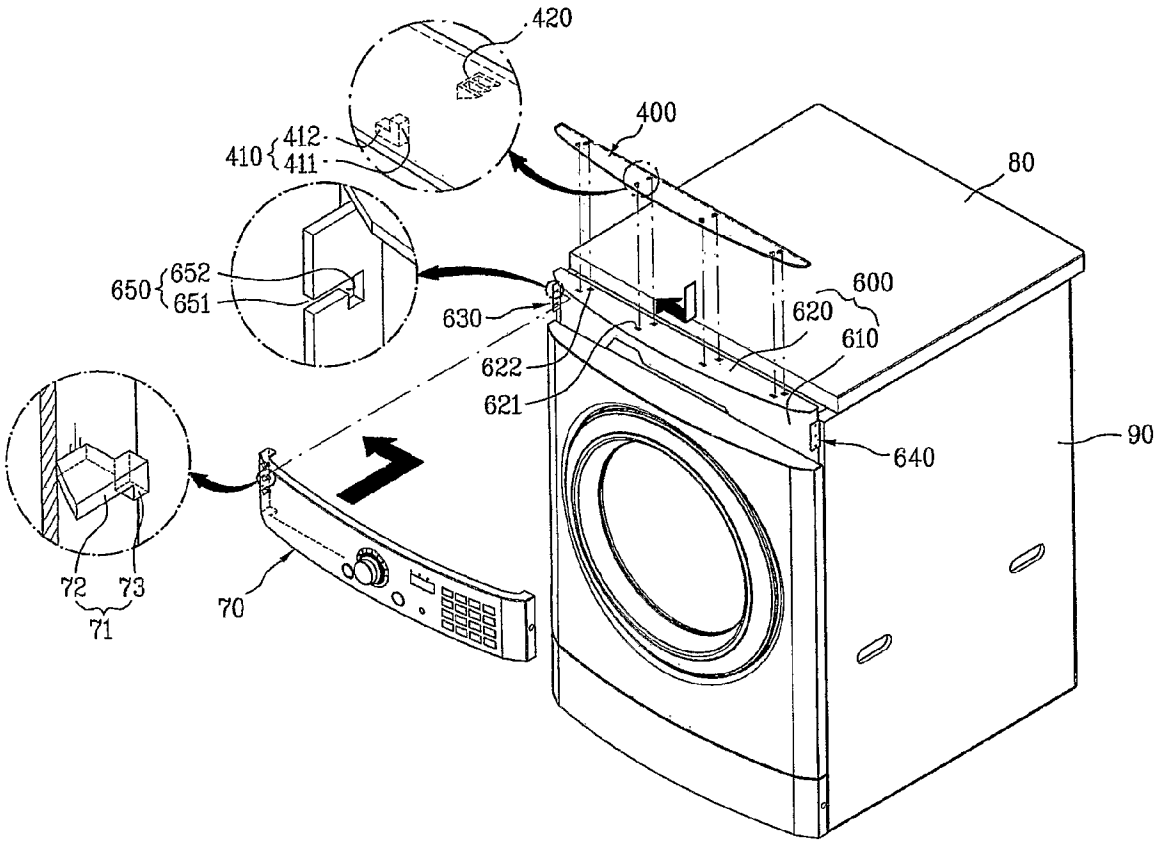
FIG. 10 is an exploded perspective diagram of a washing machine according to a fourth embodiment of the present invention, in which an assembly of a control panel and deco of the washing machine is schematically shown.
Figure 11:
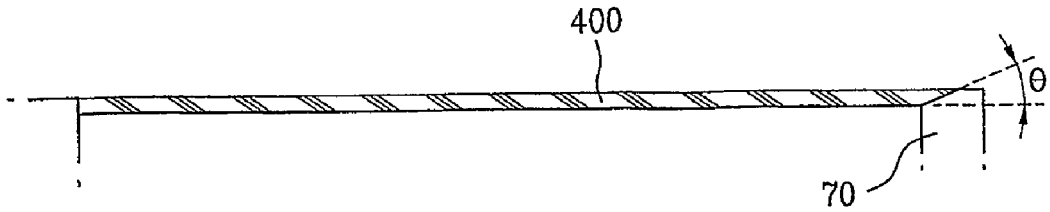
FIG. 11 is a cross-sectional diagram of a deco provided to a control panel according to a fourth embodiment of the present invention.
Figure 12:
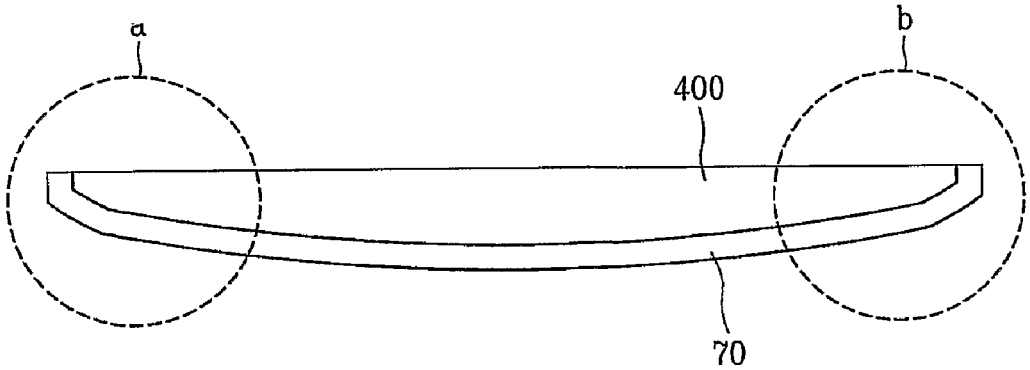
FIG. 12 is a layout of a control panel and deco according to a fourth embodiment of the present invention.

FIG. 10 is an exploded perspective diagram of a washing machine according to a fourth embodiment of the present invention, in which an assembly of a control panel and deco of the washing machine is schematically shown, FIG. 11 is a cross-sectional diagram of a deco provided to a control panel according to a fourth embodiment of the present invention and FIG. 12 is a layout of a control panel and deco according to a fourth embodiment of the present invention.

Referring to FIG. 10, a washing machine according to a fourth embodiment of the present invention includes a body case 90, a panel frame 600 provided to a lower or upper part of a front side of the body case 90, a control panel 70, and a deco 400.

The control panel 600 shall be assembled to the panel frame 600 that is provided to an upper end of an open front end of the body case 90.

The panel frame 600 includes a body part 610 shielding the open front end of the body case 90 and an upper flange part 620 bent along a circumference of an upper end of the body part 610 in a front direction to be assembled to an upper side of an inside of the control panel 70.

The control panel 70 for performing various manipulations for an operation of the washing machine is configured to be detachably attached to a front side of the panel frame 600 by enclosing an entire circumference of the panel frame 600.

Preferably, in being assembled to the panel frame 600, the control panel 70 slides to move from the front side of the panel frame 600 toward one side so that the control panel 70 can be placed in an optimal position where the panel frame will be finally assembled.

For this, the fourth embodiment of the present invention further includes a sliding projection 410 provided to the control panel 70, locking brackets 630 and 640 provided to the panel frame 600, and a sliding recess 650 provided to the panel frame 600.

In this case, the sliding projection 410 is provided to one side of a backside of the control panel 70.

Preferably, the sliding projection 410 includes a support end 411 built in one body off the control panel 70 and a bent end 412 bent downwardly or upwardly from an inner end portion of the support end 411.

The locking brackets 530 and 640 are configured to be projected from both lateral sides of the panel frame 600 in a front direction, respectively. And, the sliding recess 650 is provided to the locking bracket (hereinafter named 'first locking bracket) 630 opposing the sliding projection 410 of the control panel 70.

The sliding recess 650 is configured to have a slit shape cut to an end portion of the first locking bracket 630.

And, the sliding recess 650 includes a horizontal recessed end 651 to have the support end 411 of the sliding projection 410 fitted therein and a vertical recessed end 652 to have the bent end 413 of the sliding projection 410 fitted therein.

In this case, a cutting width of the sliding recess 650 is decided to have a size enough to have the support end 411 smoothly inserted therein.

Preferably, at least two of the sliding projections 410 and at least two of the sliding recesses 650 are provided to correspond to each other.

A locking member is provided to the locking bracket (hereinafter named 'second locking bracket) 640 failing to have the sliding recess 650 and a lateral side of the control panel 70 opposing the second locking bracket 640 to prevent the control panel 70 from moving in both directions. And, the locking member include a screw (not shown in the drawings) in general.

Meanwhile, a locking means for locking the deco 400 includes an upper flange part 620 provided to the panel frame 600, a sliding locking recess 621 provided to the upper flange part 620 to have a slit shape in a lateral direction, and a sliding locking projection 410 provided to a bottom side of the deco 400 to correspond to the sliding locking recess 621.

The sliding locking projection 410 includes an insertion piece 411 inserted in the sliding locking recess 621 and a hanging piece 412 bent in a lateral direction of the insertion piece 411 not to be separated upwardly by being interrupted by the upper flange part 620 in case of moving the deco 400 from one side to the other side on the upper flange part 620 after having been fitted into the sliding locking recess 621.

Meanwhile, a projecting portion 420 having a wedge shape upwardly inclined from the other side in a direction of one side is provided to a lower part of the deco 400. In this case, the projecting portion 420 facilitates the deco 400 from being separated in a manner of being automatically floated from the upper flange part 620 if the deco 400 slides to move from the other side to one side on the control panel 70. And, an insertion portion 622 is provided to the upper flange part 620 of the control panel 70 to correspond to the projecting portion 420.

Preferably, in case that the deco 400 is moved from the other side to one side to be separated, an incline, as shown in FIG. 11 and FIG. 12, upwardly inclining at a predetermined angle (θ) is provided to one side portion ('a' in the drawing) of the deco 400 to facilitate the separation.

More preferably, a portion of the control panel 70, as shown in the drawing, opposing the one lateral side deco 400 provided with the incline is configured to have an incline corresponding to that of the deco 400.

Meanwhile, it is preferable that the other side of the deco 400 opposing the control panel 70 is configured vertical instead of having an incline. This is to separate both of the control panel 70 and the deco 400 from each other by one action in a manner that the deco 400 is moved together with the control panel 70 that is moved from the other side to one side.

In particular, the end portions of the deco 400 and the control panel 70 coming into contact with each other are configured to be straight.

A process for assembling the control panel 70 to the panel frame 600 of the washing machine according to the fourth embodiment of the present invention is explained in detail with reference to FIG. 10 as follows.

First of all, an inner wall of the lateral side of the control panel 70 having the sliding projection 410 is placed in the vicinity of an outer wall of the first locking bracket 630 of the panel frame 600. The control panel 70 is then pushed toward the panel frame 600 in a direction indicated by the arrow shown in the drawing.

If so, the support end 411 of the sliding projection 410, as shown in FIG. 10, is fitted into the horizontal recessed end 651 of the sliding recess 650 provided to the first locking bracket 630.

In this case, the bent end 412 of the sliding projection 410 is spaced apart from the vertical recessed end 652 of the sliding recess 650, whereby the control panel 70 is free to move back and forth.

Subsequently, the control panel 70 is moved (in a left direction in the drawing) to have the bent end 412 located within the vertical recessed end 652.

If so, the bent end 412 provided to the control panel 70, as shown in FIG. 10, is placed within the vertical recessed end 652 provided to the first locking bracket 630. So, the control panel 70 is unable to move in a front direction of the panel frame 600.

Moreover, the inner wall of an opposite side (right side in the drawing) of the control panel 70 comes into adhering closely to the outer wall of the second bracket 640.

The right lateral side of the control panel 70 and the second locking bracket 640 are then locked together by a screw (not shown in the drawing) to prevent the control panel 70 from moving.

After the control panel has been locked, the deco 400 is locked by being pushed from one side to the other side along the upper flange part 620.

In particular, after the sliding locking projection 410 has been inserted in the sliding locking recess 621, if it is pushed from one side to the other side, the projecting portion 420 is moved until being completely inserted in the insertion portion 622 to complete the assembly.

Meanwhile, in case of disassembling the control panel 70 from the panel frame 600, a process is performed in a sequence reverse to that of the assembling process. In the embodiment of the present invention, if the control panel 70 is pushed from the other side to one side for the separation of the control panel 70, the deco 400 is simultaneously pushed in the same direction to be separated from the flange part 220.

Thus, the washing machine according to the present invention is able to disassemble the control panel and the deco from each other without separating the upper cover. And, the upper cover can be disassembled together with the control panel.

In this case, the cover panel can be installed as well, which is explained in detail in the description of the washing machine according to the first embodiment of the present invention and omitted n the following description.

In the respective embodiments of the present invention, the panel frame attached to the upper or lower part of the front side of the body case has the same or different configuration but is configured to enable the attachments of the control panel and the cover panel.

Besides, in the respective embodiments of the present invention, the devices for the manipulations of the control panel such as the printed circuit boards and the like are compatibly provided to the upper and lower parts of the body case to enable the manipulations of the buttons and the like provided to the control panel no matter which part (upper part or lower part) the control panel is attached to.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

Accordingly, the present invention provides the following effects or advantages.

First of all, a position of the control panel can be freely modified according to an arranged state of the washing machine, whereby a user is facilitated to manipulate the control panel regardless of the arranged state of the washing machine. In particular, by providing the panel frame and the lower panel frame to the position where the control panel is supposed to be attached, it is able to stably protect the control panel from heat or water from the inside of the washing machine.

Secondly, since the lower panel frame of the washing machine according to the present invention is attached to the body case with ease and stably, the present invention prevents the user's inconvenience caused by the position change of the control panel.

Thirdly, in case of stacking the washing machines of the present invention, the control panel can be selectively provided to the upper or lower part of the outer case to facilitate the manipulation of the control panel, whereby the washing machine can be conveniently used.

The invention claimed is:

1. A washing machine, comprising:

a body case that defines an exterior of the washing machine;

a top plate provided at a top end of the body case;

a control panel attached to a front side of the body case; and a panel frame provided at an upper end or a lower end of the front side of the body case so as to be partially externally exposed, wherein the panel frame has a first side thereof connected to the top plate and a second side thereof coupled to the control panel, wherein the panel frame is formed from a continuous sheet of material, the panel frame comprising:

a decorative part oriented in parallel with the top plate and externally exposed;

a locking end that is bent vertically and downwardly from a front side of the decorative part so as to be engaged with the control panel;

a vertical end that is bent vertically and downwardly from a rear side of the decorative part and contacts a front side surface of the top plate; and a support end that is bent from a top portion of the vertical end, wherein the support end extends rearward to support the top plate and contacts a lower side surface of the top plate.

2. The washing machine of claim 1, further comprising:

a hanging hole formed in the locking end; and a hanging projection provided at the control panel, wherein the control panel is connected to the panel frame by the hanging projection received in the hanging hole.

3. The washing machine of claim 2, further comprising a hook provided at one end portion of the hanging projection.

4. The washing machine of claim 2, wherein the hanging hole comprises a plurality of the hanging holes arranged along a length direction of the panel frame and wherein the hanging projection comprises a corresponding plurality of the hanging projections arranged on the control panel to respectively correspond to the plurality of hanging holes.

5. The washing machine of claim 2, wherein the hanging hole comprises a plurality of the hanging holes provided along a length direction of the control panel and wherein the hanging projection comprises a plurality of the hanging projections provided on the panel frame panel to respectively correspond to the plurality of hanging holes, respectively.

6. The washing machine of claim 5, further comprising a hook provided at one end portion of the hanging projection.

7. The washing machine of claim 1, further comprising:

a hanging projection provided at the locking end; and a hanging hole provided at the control panel, wherein the hanging projection is held by the hanging hole.

8. The washing machine of claim 1, further comprising a cover panel provided at a portion of the front side of the panel frame or at the lower end of the front side of the body, at a position where the control panel not located.

9. The washing machine of claim 8, wherein a detachable configuration between the panel frame and the cover panel is the same as that between the panel frame and the control panel.

* * * * *